United States Patent [19]

Evans et al.

[11] 4,041,865

[45] Aug. 16, 1977

[54] METHOD AND APPARATUS FOR DETONATING EXPLOSIVES

[75] Inventors: Seth F. Evans, Seal Beach; Jairus Donn Hall, Newport Beach, both of Calif.

[73] Assignee: Seth F. Evans, Seal Beach, Calif.

[21] Appl. No.: 583,638

[22] Filed: June 4, 1975

[51] Int. Cl.[2] ..... F42D 1/04

[52] U.S. Cl. ..... 102/20; 102/21.8; 102/70.2 R

[58] Field of Search ..... 102/20, 21.6, 21.8, 102/70.2, 81; 317/80; 175/4.51–4.54

[56] References Cited

U.S. PATENT DOCUMENTS

| | | | |
|---|---|---|---|
| 3,180,261 | 4/1965 | Moore | 102/20 |
| 3,343,493 | 9/1967 | Aulds et al. | 102/70.2 |
| 3,375,785 | 4/1968 | Moore | 102/20 |
| 3,805,703 | 4/1974 | Cummings | 102/70.2 |

*Primary Examiner*—Verlin R. Pendegrass
*Attorney, Agent, or Firm*—Fulwider, Patton, Rieber, Lee & Utecht

[57] ABSTRACT

A detonating device principally intended for detonating an explosive charge in a well or borehole, and of the type which is actuated by pulling upwardly on a non-electrical line also used to lower the device into position. The device includes self-contained time-delay circuitry which requires a sustained mechanical actuating pull on the line for some predetermined time before an attempt is made to detonate the explosive. The circuitry includes a command switch actuated by pulling on the line, and a safety switch which must be closed before the command switch is closed, either manually or by hydrostatic pressure in the borehole. The circuitry locks in a safe condition if the command switch is closed first, or if one attempt has been made to fire the explosive, whether successful or not, thus allowing removal or repositioning of the device with complete safety.

40 Claims, 4 Drawing Figures

90
10
94
96
14a
98
12
92
116
16
20
20
18
18
106
110
112
112
114
114
14b
32
108
100
102
14c
118
104
28
24
140
30
22a
14d
22
121

22b
14d
34
26
130
36
126a
128
121
126b
126
122
126c
14e
134
127
38
132
136
TO EXPOSIVE CHG.

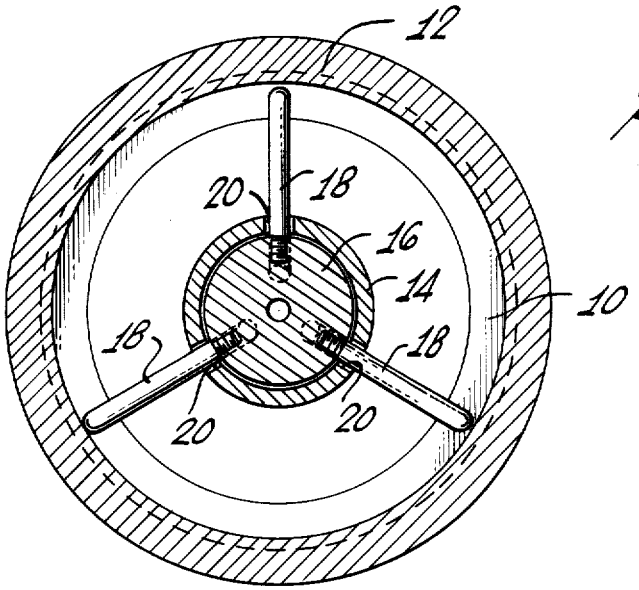
Fig. 3
Fig. 4
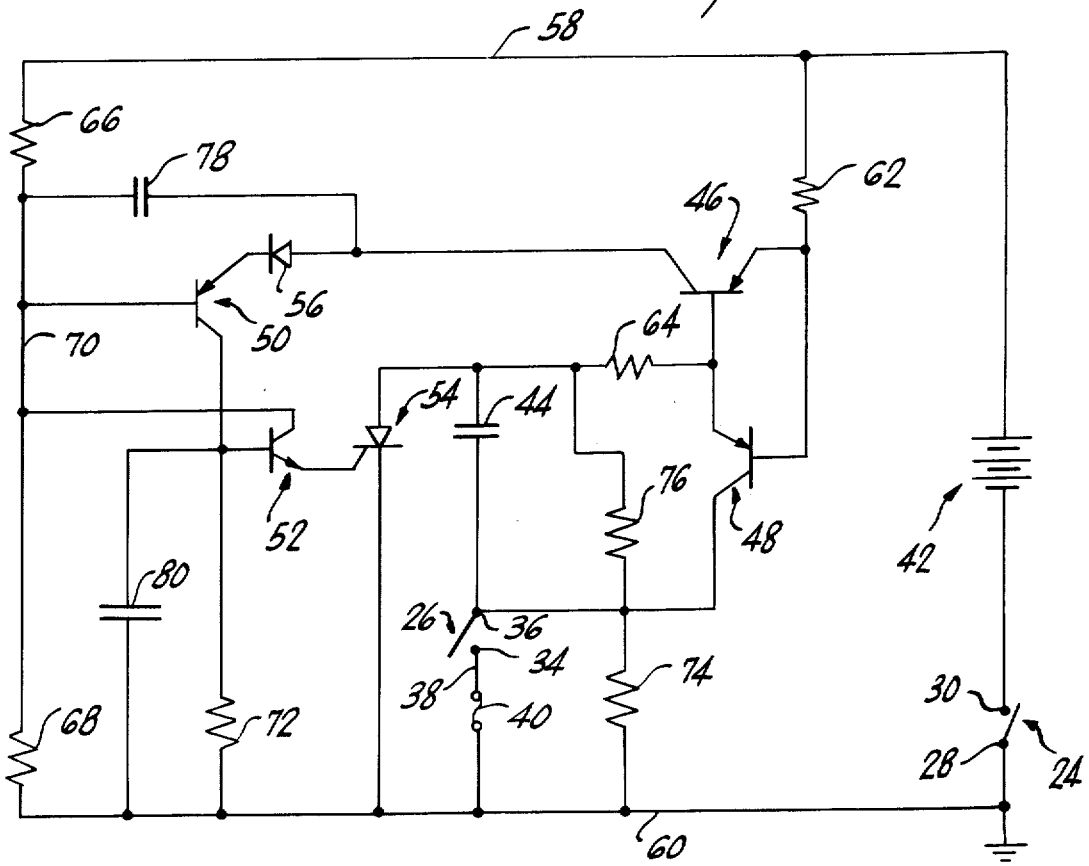

METHOD AND APPARATUS FOR DETONATING EXPLOSIVES

BACKGROUND OF THE INVENTION

This invention relates generally to detonator apparatus, and, more particularly, to detonator apparatus for actuation underground in a borehole, usually by means of a line mechanically attached to the apparatus.

For a variety of reasons, it is often necessary to detonate an explosive device deep in a borehole or well, such as an oil well, and the detonation must, of course, be effected remotely and safely. A common technique for actuating such devices utilizes a non-electrical wire or line to the surface, which is pulled to actuate the device, often by means of some type of plunger mechanism to close a switch and thereby fire the explosive. Some devices employing this technique include a hydraulic safety mechanism which necessitates a long, steady pull on the actuating line to actuate the device. Another technique makes use of one or more time-delay mechanisms to allow time for placement of the explosive.

Inventors and engineers working with devices of the same general type as the present invention have long striven to improve the safety of operation of the devices. An underground explosive charge to be detonated in a borehole usually must be accurately positioned. If it has to be repositioned, or totally removed, or if there is a malfunction of the mechanism, it is absolutely essential that the device can be repositioned, or removed from the borehole and disarmed, if desired, without accidental firing of the explosive charge. Detonator devices of this type available heretofore are deficient in many respects relating to safety of operation. Those that rely solely on mechanical actuation may not be repositioned or removed from a borehole without substantial risk of premature explosion. Similarly, those that employ time-delay mechanisms to provide time to properly position the explosive charge do not provide for safe removal and disarming in the event of a malfunction or a change in plans.

In some instances, it may be necessary to place an explosive charge at a certain distance below the surface level of water or oil in a borehole; yet the precise depth of the liquid surface level in the borehole may not be known, or may be changing. It is highly desirable, therefore, to provide some automatic means for arming the detonator apparatus only when it is positioned at the desired depth.

It will be apparent that there has long been a need for a detonator device which satisfies the foregoing requirements relating to safety and convenience of operation. The present invention satisfies this need.

SUMMARY OF THE INVENTION

The present invention resides in detonator apparatus, and a corresponding method of detonating an explosive charge, wherein an electrical time delay is utilized to measure a predetermined time interval during which actuation of a command switch must be sustained in order to detonate the explosive charge. Briefly, then, and in general terms, the apparatus of the invention includes electrical time-delay means actuated by sustained operation of the command switch, and means for firing a detonator fuse after a predetermined delay time has passed.

Also included are means for automatically resetting the time-delay means in the event that the command switch is released before the predetermined time delay has passed, and electrical interlock means to prevent recycling of the time-delay means after the first attempt to fire the fuse, whether successful or not. Thus, if the command switch is released deliberately, or if electrical contact through the switch is lost by a malfunction, the time-delay means resets automatically, and a new full delay is timed out when the switch is closed again, ensuring that there will be no accidental firing due to an accumulation of times during which the command switch is closed. Furthermore, the electrical interlock means permits only one attempt at firing the fuse. If the first attempt fails because of absence malfunction of the fuse, or for any other reason, no further attempt can be made until the command switch is opened, releasing the electrical interlock means, and then held closed for the prescribed delay time. Accordingly, the apparatus can be safely repositioned or removed from the borehole without risk of an explosion, in the event of a malfunction preventing firing of the fuse, or for any other reason.

As an additional safety feature, the apparatus of the present invention includes a safety switch which must be actuated prior to the command switch. The safety switch can be manually closed before the apparatus is positioned in the borehole. Alternatively, the safety switch can be closed automatically by a hydrostatic actuator set to operate when the apparatus reaches a predetermined depth below the surface of water or other liquid in the borehole.

The electrical time delay means and associated electrical apparatus are usually used in conjunction with mechanical means for actuating the apparatus. Briefly, the mechanical means includes an elongated housing to which the actuating line is attachable, plunger means movable in the housing, and grappling means, such as a number of outwardly and upwardly projecting fingers attached to the plunger means. The fingers lodge under a borehole pipe end, or other surface irregularity of the borehole, when the apparatus is lowered into position, and resist upward movement of the plunger means, so that an upward pull on the line results in relative movement of the plunger means with respect to the housing. This relative movement is utilized to close the command switch, and resilient means are included to urge the command switch open when tension on the line is released.

In the preferred embodiment of the invention, the time-delay means includes an electrical capacitor and a power supply. Preferably, the power supply is selected to be incapable of supplying sufficient current to fire the detonator fuse by itself. When the capacitor reaches a predetermined charge level, i.e., after the predetermined time-delay, the capacitor is automatically connected across the fuse, and the interlock means maintains this connection until the power supply is disconnected. Then, if the capacitor is still charged, it is safely discharged through a resistive path, and has to be fully charged again when the power supply is reconnected.

In terms of a method of safely firing a detonator fuse, the invention includes the steps of lowering the apparatus into a well or borehole, closing the command switch for a predetermined time, charging an energy storage component while the command switch is closed, generating a triggering signal when the predetermined time has elapsed, connecting the energy storage component across the fuse, and automatically latching the apparatus to prevent further attempts at firing the fuse until tension on the line is released and reapplied for a further time-delay.

It will be appreciated from the foregoing that the present invention represents a substantial step forward in the art of detonation of explosives. In particular, the use of an electrical time delay to prevent firing of the device without a sustained actuation of the control switch prevents inadvertant explosions. The provision of an interlock to prevent unwanted recycling of the apparatus, and a safety switch, which may be hydrostatically actuated, further increase the safety, reliability and convenience of the apparatus. Other aspects and advantages of the invention will become apparent from the following detailed description, taken in conjunction with the accompanying drawings.

BRIEF DESCRIPTION OF THE DRAWINGS

FIG. 3 is a section view of the apparatus taken substantially along the line 3—3 of FIG. 1; and FIG. 4 is an electrical schematic diagram of the apparatus of the invention.

DETAILED DESCRIPTION

Figure 1:
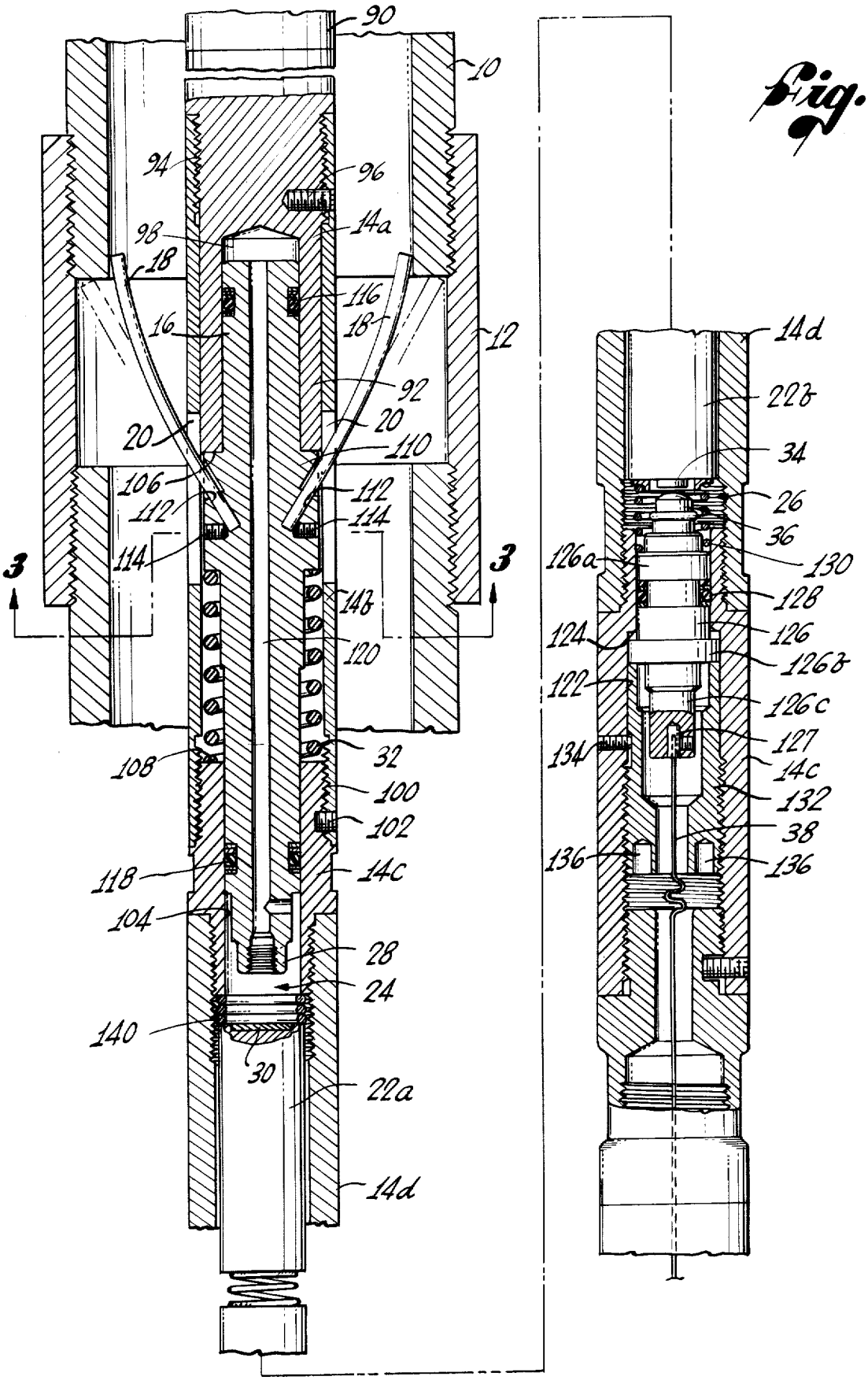
FIG. 1 is an elevational view, partly in section, of detonator apparatus embodying the present invention, with the command and safety switches in an open position.
Figure 2:
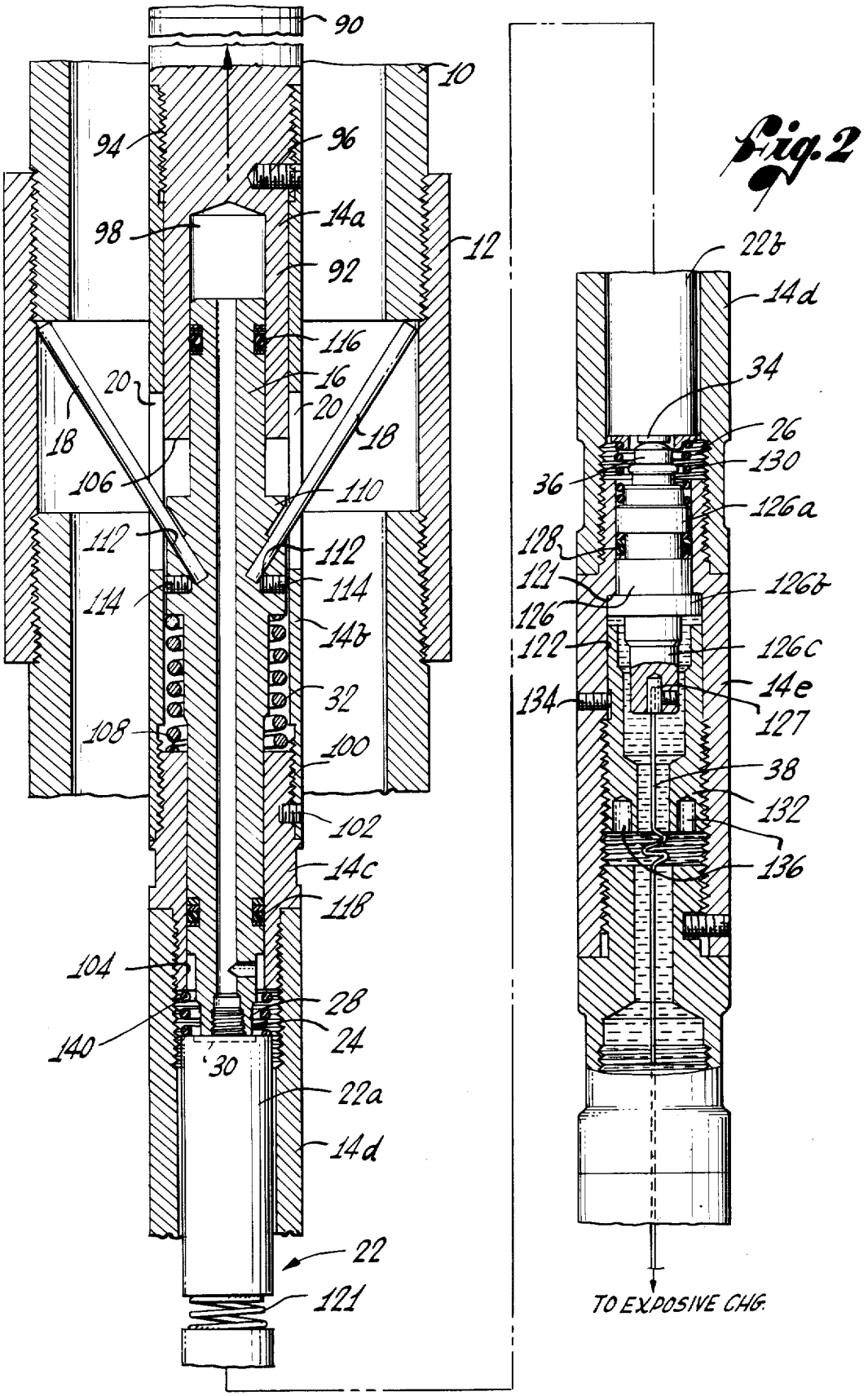
FIG. 2 is a view similar to FIG. 1, but with the command and safety switches in a closed position.

As shown in the drawings for purposes of illustration, the present invention is embodied in an explosive detonation device principally intended for use in a well or borehole. Usually, and as shown in FIGS. 1-3, the borehole is lined for at least part of its length by a number of lengths of casing pipe, indicated by the reference numeral 10, joined by threaded collars, one of which is shown at 12 in FIGS. 1 and 2. Basically, the device comprises an elongated and generally cylindrical housing 14 which, as will be further explained, is made up of several threadably joined pieces **14*a*-14*e*, and a plunger assembly 16** which is movable axially in the housing.

In common with some other devices of the same general type as this invention, the plunger assembly 16 has affixed to it a number, in this case three, of stiff but bendable wire fingers 18 projecting outwardly and upwardly from the plunger assembly, through corresponding openings 20 in the housing 14. As the device is lowered into a borehole, the fingers 18 are bent inwardly to fit inside the casing 10, and spring out to a substantially straight position as each collar 12 is reached.

When the device reaches a desired depth in the borehole, it is actuated by pulling upwardly on a line (not shown) attached to the housing 14. The fingers 18 engage under a section of casing 10, as shown in FIG. 2 and in phantom in FIG. 1, thus restraining upward movement of the plunger assembly 16 and causing relative motion between the plunger assembly and the housing 14. This relative motion is utilized, as in some other devices of the same type, to initiate electrically the firing of an explosive charge (not shown). Safety of operation is often an elusive objective in the design of devices of this type. It is highly desirable that a user should be able to reposition or remove the device without danger of explosion, and that component failures should not render the device unsafe.

In accordance with the present invention, an electrical circuit, shown in detail in FIG. 4, is utilized to provide a time delay during which there must be a sustained mechanical actuation of the device, i.e., a continuous upward pull on the housing 14, in order for a firing current to be generated to detonate the explosive charge. The circuit of FIG. 4, which also provides various other safety features, to be discussed in more detail below, is contained in its own housing 22 which, in turn, is contained within the device housing 14.

The apparatus of the invention includes two mechanically operated switches, a command switch 24 and safety switch 26. The command switch 24 is a single-pole, single-throw switch having a first contact 28 on the lower end of the plunger assembly 16, and second contact 30 on the upper end of the time-delay circuit housing 22. The command switch is closed by an upward force on the device housing 14. A coiled compression spring 32 between the plunger assembly 16 and the housing 14 urges the plunger assembly upwardly with respect to the housing, and holds the command switch 24 normally open.

The safety switch 26 has a first contact 34 on the lower end of the time-delay circuit housing 22, and a second contact 36 which is electrically connected, by a wire 38, to a detonating fuse, shown at 40 in FIG. 4, located some distance further down the borehole. As will be explained in more detail, the safety switch 26 may be manually closed before the device is lowered into the borehole, or may be arranged to be closed when a preselected minimum hydrostatic pressure is reached. In any event, if the safety switch 26 is first closed, and the command switch 24 is held closed for the required time delay, an electrical signal sufficient to fire the fuse 40 is generated between the first safety switch contact 34 and the device housing 14. The fuse 40 is grounded to the housing 14 by one terminal, and is connected through the wire 38 and safety switch 26 to the contact 34, so that the firing signal is applied directly to the fuse.

As already mentioned, the circuitry for generating the firing signal across the fuse 40 is shown in detail in FIG. 4. It includes a battery 42, a capacitor 44, three pnp transistors 46, 48 and 50, an npn transistor 52, a silicon controlled rectifier 54, a diode 56, and various resistors and capacitors. The positive terminal of the battery 42 is connected to a positive bus 58, and the negative terminal of the battery is connected through the command switch 24 to a negative bus 60 which is grounded to the device housing 14 (FIGS. 1-3).

Transistor 46 has its emitter terminal connected through a resistor 62 to the positive bus 58, and its base terminal connected through another resistor 64 to one terminal of the capacitor 44. The other terminal of the capacitor 44 is connected to the safety switch 26, and thence by line 38 to one terminal of the detonator fuse 40, the other terminal of which is grounded to the negative bus 60. When the safety switch 26 and the command switch 24 are both closed, current flows from the battery 42, through resistor 62, through the transistor 46 from emitter to base, and through resistor 64, to charge the capacitor 44. The charging circuit is completed through the safety switch 26, the fuse 40, and the command switch 24. The charging rate for the capacitor 44 depends, of course, on the capacitance of the capacitor and the value of the series resistance provided by resistors 62 and 64.

Connected between the positive and negative buses 58 and 60 is a voltage divider made up of two resistors 66 and 68 in series, selected to provide an intermediate voltage, on line 70, of approximately two-thirds of the voltage of the battery 42. The collector terminal of transistor 46 is connected to the anode of the diode 56, the cathode of which is connected to the emitter terminal of transistor 50. Transistor 50 has its base terminal connected to the intermediate voltage on line 70, and has its collector terminal connected to the base terminal of transistor 52 and, through another resistor 72, to the negative bus 60.

The collector terminal of transistor 52 is also connected to the intermediate voltage on line 70, and the emitter terminal is connected directly to the gate terminal of the silicon controlled rectifier 54. The anode of the silicon controlled rectifier 54 is connected to the positively charged terminal of the capacitor 44, i.e., the terminal connected to the positive terminal of the battery 42 through resistors 62 and 64 and transistor 46. The cathode of the silicon controlled rectifier 54 is grounded to the negative bus 60.

The collector terminal of transistor 52 is also connected to the intermediate voltage on line 70, and the emitter terminal is connected directly to the gate terminal of the silicon controlled rectifier 54. The anode of the silicon controlled rectifier 54 is connected to the positively charged terminal of the capacitor 44, i.e., the terminal connected to the positive terminal of the battery 42 through resistors 62 and 64 and transistor 46. The cathode of the silicon controlled rectifier 54 is grounded to the negative bus 60.

In operation, the circuit of FIG. 4 charges the capacitor 44 when the safety switch 26 and command switch 24 are closed, as has already been explained. As charging of the capacitor 44 proceeds, the voltage at the collector terminal of transistor 46 and the voltage at the emitter terminal of transistor 50 rise. The intervening diode 56 is included only to increase the apparent base-emitter breakdown voltage of transistor 50. When the charge in the capacitor 44 reaches a predetermined level, the voltage at the emitter of transistor 50 will exceed the base-terminal voltage derived from line 70, and the transistor 50 will turn on.

When transistor 50 turns on, this raises the voltage at the base terminal of transistor 52 which is also turned on as a result. Conduction of transistor 52 lowers the voltage on line 70 and thereby further locks transistor 50 in a conductive state. Conduction of transistor 52 also applies a signal to the gate of the silicon controlled rectifier 54, which also becomes conductive. It will be apparent that the silicon controlled rectifier 54 effectively connects the charged capacitor 44 directly across the fuse 40, thereby firing the fuse and detonating the explosive charge.

After a first attempt to fire the fuse 40, whether successful or not, if battery power is still connected to the circuit the resistor 64 provides sufficient bias voltage to keep transistors 50 and 52 and the silicon controlled rectifier 54 all in a conductive state, thereby preventing recycling of the circuit. The capacitor 48 can only be charged again by disconnecting battery power, and thereby allowing the transistors 46, 50 and 52 and the silicon controlled rectifier 54 to return to their non-conductive states.

If the fuse 40 is open-circuited for some reason, or if the safety switch 26 is not closed before the command switch 24 is closed, a charging circuit is first established through another resistor 74, which is connected across the safety switch 26 and fuse 40. The resistance values are chosen such that, in this configuration, there is immediately a high enough voltage at the emitter of transistor 50 to cause triggering of transistors 50 and 52 and silicon controlled rectifier 54. This effectively short-circuits the capacitor 44 and prevents charging. Moreover, the circuit will remain locked in this configuration until the command switch 24 is opened.

Transistor 48 has its base terminal connected, with the emitter of transistor 46, to the resistor 62, its emitter terminal connected to the base of transistor 46, and its collector terminal connected to the contact 36 of the safety switch 26. In effect, then, transistor 48 is connected by its emitter and collector terminals in series with the capacitor 44 and resistor 64. When battery power is removed from the circuit, as by opening the command switch 24 before a full charge is attained, transistor 48 effectively short-circuits the capacitor 44 and rapidly discharges it, so as to reset the timing sequence for any renewed attempt to fire the fuse 40. Another resistor 76, having a relatively large resistance, is permanently connected directly across the capacitor 44 to ensure complete discharge after battery power has been removed.

Additional capacitors 78 and 80 provide a by-pass path for high-frequency signals which might result from noise spikes or radio-frequency interference, and might otherwise prematurely trigger discharge of the timing capacitor 44. Capacitor 78 is connected between the anode of the diode 56 and line 70, and capacitor 80 is connected across resistor 72. Resistor 72 provides a high-resistance leakage path for transistors 50 and 52, to prevent premature firing at high temperatures or with "leaky" transistors.

It will be apparent from the foregoing description of the time-delay circuitry that the capacitor 44 serves the dual puposes of timing and energy storage. The time-delay before firing can be for any desired period, for example, sixty seconds. For increased safety, the battery 42 is selected for its incapacity to fire the fuse 44 wthout a capacitor. In summary, the safety features of the circuit are that only one attempt is made to fire the fuse, so that a defective fuse can be replaced without danger; the safety switch 26 must be closed before the command switch 24; the timing resets automatically if the command switch is reopened before the time delay is up; and the circuit is, as far as practicable, "failsafe" in operation, i.e., failure of a component leaves the capacitor 44 in a safe, discharged condition.

Although it will be apparent that the circuit can be designed with various selections of components and parameters, the following are provided as exemplary of the invention:

| | |
|---|---|
| Transistors 46, 48 and 50 | 2N4248 |
| Transistor 52 | 2N3565 |
| SCR 54 | MCR406-1 |
| Diode 56 | 1N456A |
| Capacitor 44 | 2100μF |
| Capacitors 78 and 80 | 0.01μF |
| Resistors 62 and 66 | 10kΩ |
| Resistors 68, 74 and 76 | 22kΩ |
| Resistor 64 | 2,200Ω |
| Resistor 72 | 100kΩ |
| Battery 42 | 22.5v |

With regard to the mechanical details of the invention, it will be apparent from FIGS. 1 and 2 that the housing 14 of the device is comprised of an upper trigger housing 14a, a lower connector sleeve 14b, a lower trigger housing 14c, an upper connector sleeve 14d, and a safety switch housing 14e. The upper trigger housing 14a is the uppermost portion of the housing 14. It has an upper, solid cylindrical end portion 90 to which the mechanical actuating line (not shown) is attached, and a lower portion 92 of reduced diameter which fits closely inside the upper connector sleeve 14b and is threadably attached thereto, as indicated at 94 by male threads on the lower portion 92 and female threads at the upper end of the connector sleeve. A set screw 96 is used to lock the upper connector sleeve 14b to the upper trigger housing 14a. The reduced-diameter lower portion 92 has a bore 98 open at its lower end to receive a portion of the plunger assembly 16.

The lower trigger housing 14c is similarly attached to the lower end of the upper connector sleeve 14b, i.e., it is threadably attached, as indicated at 100, by external threads on the lower trigger housing and internal threads on the upper connector sleeve, and locked in position by means of a set screw 102. The lower trigger housing 14c has central bore 104 through its entire length and is externally threaded at its lower end for attachment to the lower connector sleeve 14d. It will be seen that the assembled upper trigger housing 14a, upper connector sleeve 14b, and lower trigger housing 14c together define a cylindrical chamber with bores 98 and 104 at its ends, and a larger diameter central region bounded by an upper annular shoulder 106 and a lower annular shoulder 108.

The plunger assembly 16, is for the most part, cylindrical, and has upper and lower end portions sized for a sliding fit in the bores 98 and 104, respectively. The plunger assembly 16 also has a central portion 110 of increased diameter, sized for a clearance fit inside the upper connector sleeve 14b. The coil spring 32 is positioned between the central portion 110 of the plunger assembly 16 and the lower shoulder 108, and normally urges the plunger assembly upwardly with its enlarged central portion abutting the upper shoulder 106. The previously mentioned wire fingers 18 are secured in angled openings 112 in the central portion 110 of the plunger assembly 16 by set srews 114, and project through the openings 20 in the upper connector sleeve 14b. Since liquid may be admitted through the openings 20, O-ring seals 116 and 118 are provided to ensure sealing contact of the plunger assembly 16 with the bores 98 and 104, respectively.

The contact 28 of the command switch 24 takes the form of a reduced-diameter portion at the lower end of the plunger assembly 16. It will be apparent that, once the fingers 18 have lodged under a section of casing 10, as in FIG. 2, an upward force on the housing 14 will result in a relative downward movement of the plunger assembly 16, with respect to the housing, and in compression of the spring 32, as shown in FIG. 2. A passage 120 extends from one end of the plunger assembly 16 to the other, to ensure that the pressure forces acting at each end are equal, especially in the event of leakage past either of the O-rings 116 and 118.

As already mentioned, the lower trigger housing 14c is threadably attached to the lower connector sleeve 14d. It is the lower connector sleeve 14d that contains the separate housing 22 for the time-delay circuitry (FIG. 4). The circuitry housing 22 has command-switch contact 30 at its upper end, and safety-switch contact 34 at its lower end. More specifically, the circuitry housing 22 in the illustrative embodiment comprises, as shown in FIG. 2, an upper portion 22a housing the battery 42 (FIG. 4) and a lower portion 22b housing the remainder of the circuitry. The two portions 22a and 22b are separated by a light spring 121, which also serves as an electrical connection from the battery 42 to the positive bus 58 of the circuitry. (See FIG. 4)

The safety switch housing 14e is threadably attached to the lower end of the lower connector sleeve 14d, and has an axial hole 122 therethrough. The hole 122 has an annular shoulder 124 therein, defining a diameter increase toward the lower end of the housing 14e, and is internally threaded over approximately the lower half of its length. Fitted in the hole 122 is a hydrostatic piston assembly 126, including a cylindrical portion 126a slidingly fitted in that portion of the hole 122 above the shoulder 124, a piston 126b sized to slidingly fit that portion of the hole 122 below the shoulder 124, and an integral boss 126c projecting below the piston and adapted, as shown at 127, to electrically connect to the wire 38 to the fuse. An O-ring seal 128 fitted to the cylindrical portion 126a prevents upward leakage of fluid, and the cylindrical portion is tapered at its upper end to form the safety-switch contact 36.

A hydrostatic switch spring 130 is positioned between the piston assembly 126 and the circuit housing 22 and normal urges the safety-switch contacts 34 and 36 open. An internal sleeve 132 threadably secured in the safety switch housing 14e provides a lower abutment for the piston 126b, and thereby limits its downward movement. Hydrostatic pressure on the lower side of the piston 126b tends to raise the piston assembly 126, and when a predetermined pressure is reached, closes the safety switch 26.

As an alternative to hydrostatic operation of the safety switch 26, the switch may be manually closed by rotating the internal sleeve 132 and thereby raising the piston 126b. A set screw 134 is used to lock the internal sleeve 132 in either of its positions, and holes 136 are provided in the lower end of the internal sleeve 132 so that it may be rotated by a special tool (not shown) which is engagable in the holes.

Another coiled compression spring 140 is positioned between the upper portion 22a circuitry housing and the lower end of the lower trigger housing 14c to further cushion the circuitry from shock from the explosion. The hydrostatic switch spring 130 is relatively weak in comparison to the other two springs 32 and 140, so that closure of the safety switch 26, whether effected manually or hydrostatically, can be effected independently of the command switch 24. Furthermore, the spring 121 separating the two portions 22a and 22b of the circuitry housing is relatively weak is comparison to all of the other springs. Consequently the safety switch 24 cannot be closed by excessive pull on the housing 14 in closing the command switch 26. If downward movement of the plunger assembly 16 is continued after the command switch 26 has closed, this additional movement will be taken up by the very light spring 121, and not by closure of the safety switch 24. Excessive additional downward movement of the plunger assembly 16 is prevented by a small shoulder 142 on the plunger abutting the lower shoulder 108.

It will be apparent from the foregoing that the present invention, because of its numerous advantages, represents a substantial advance in art of detonating devices. First, the invention provides an extremely safe device which must be continuously actuated for some predetermined time interval before firing is attempted. Second, after the first attempt to fire the explosive, no further attempt is made until battery power is removed and reapplied for the required time interval. Third, a safety switch must be closed before firing can be initiated, and the safety switch can be hydrostatically actuated. In brief, the device is essentially "failsafe" in nature, and it may be repositioned or removed from a borehole without risk of premature explosion.

Although a particular embodiment of the invention has been described for purposes of illustration, it will be appreciated that various modifications may be made without departing from the spirit and scope of the invention. Accordingly, the invention is not to be limited, except as by the appended claims.

We claim:

1. Detonator apparatus for supplying a firing current to a fuse, said apparatus comprising:
- command switch means for initiating operation of said apparatus;
- manually operable means for closing said command switch means from a location remote from said apparatus;
- electrical time-delay and energy storage means, for generating a triggering signal after said command switch means has been closed for a predetermined time, and for simultaneously storing sufficient energy to fire the fuse, said electrical time-delay and energy storage means including resetting means for immediately reinitiating timing of the predetermined time in the event that said command switch means is opened and closed again; and
- electrical means responsive to the triggering signal, for initiating a firing current to the fuse, whereby said electrical time-delay and energy storage means is incapable of firing the fuse without a sustained closure of said command switch means for the predetermined time.

2. Detonator apparatus as set forth in claim 1, wherein:
- said electrical time-delay and energy storage means includes power supply means, electrical resistance means, and electrical capacitance means;
- said command switch means is connected to complete a circuit between said power supply means and said electrical resistance and capacitance means; and
- the triggering signal is generated when the voltage at a selected point in the circuit rises to a predetermined level as said capacitance means is charged.

3. Detonator apparatus for supplying a firing current to a fuse, said apparatus comprising:
- command switch means for initiating operation of said apparatus;
- means for closing said command switch means from a location remote from said apparatus;
- electrical time-delay and energy storage means, for generating a triggering signal after said command switch means has been closed for a predetermined time, and for simultaneously storing sufficient energy to fire the fuse, said electrical time-delay and energy storage means including power supply means, electrical resistance means, and electrical capacitance means, said command switch means being connected to complete a circuit between said power supply means and said electrical resistance and capacitance means, and the triggering signal being generated when the voltage at a selected point in the circuit rises to a predetermined level as said capacitance means is charged; and
- electrical means responsive to the triggering signal, for initiating a firing current to the fuse, whereby said electrical time-delay and energy storage means is incapable of firing the fuse without a sustained closure of said commandd switch means for the predetermined time;
- wherein said electrical means for initiating a firing current to the fuse includes electronic latching means switchable to an "on" condition for initiating the firing current in response to the triggering signal, and capable of holding in the "on" condition even when the triggering signal drops below the predetermined voltage level, whereby said electronic latching means ensures that only one attempt is made to fire the fuse.

4. Detonator apparatus as set forth in claim 3 wherein said electrical means for initiating a firing current to the fuse further includes electronic switching means responsive to the "on" condition of said electronic latching means, for connecting said electrical capacitance means across the fuse and attempting to fire the fuse, whereby said electronic switching means also effectively short-circuits said electrical capacitance means and therefore prevents recharging and the generation of a second triggering signal.

5. Detonator apparatus as set forth in claim 4, wherein said electrical time-delay and energy storage means includes resetting means for completely discharging said electrical capacitance means in the event that said command switch means is opened.

6. Detonator apparatus as set forth in claim 4, and further including a safety discharge circuit connected to discharge said electrical capacitance means if an attempt is made to fire an open-circuited fuse, thereby preventing a premature explosion on replacement of the fuse.

7. Detonator apparatus as set forth in claim 4, and further including safety switch means electrically connected in series with the fuse, to prevent operation of said apparatus unless held closed.

8. Detonator apparatus for supplying a firing current to a fuse, said apparatus comprising:
- command switch means for initiating operation of said apparatus;
- manually operable means for closing said command switch means from a location remote from said apparatus;
- electrical means for generating a firing current to the fuse after said command switch means has been closed for a predetermined delay time; and
- safety switch means electrically connected to prevent operation of said apparatus unless held closed;
- and wherein said electrical means includes means coupled with said safety switch means, to prevent operation of said apparatus unless said safety switch means is closed before closing of said command switch means.

9. Detonator apparatus as set forth in claim 8, wherein said safety switch means is manually latchable in a closed position, whereby said safety switch means may be latched closed before positioning said apparatus and actuating said command switch means.

10. Detonator apparatus for supplying a firing current to a fuse, said apparatus comprising:
- command switch means for initiating operation of said apparatus;
- means for closing said command switch means from a location remote from said apparatus;

electrical means for generating a firing current to the fuse after said command switch means has been closed for a predetermined delay time; and safety switch means electrically connected to prevent operation of said apparatus unless held closed, said safety switch means closeable by hydrostatic pressure, whereby said apparatus is operable only after it has been lowered to a predetermined depth below the surface of a liquid.

11. Detonator apparatus as set forth in claim 10, wherein said safety switch means includes:

an outer housing;

an inner piston assembly slidingly fitted inside said housing, and having a first switch contact and a hydrostatic piston;

a second switch contact; and resilient means located to urge said first and second switch contacts apart, whereby a predetermined pressure acting on said piston is sufficient to overcome the force of said resilient means and to move said first switch contact to meet said second switch contact and close said safety switch means.

12. Detonator apparatus as set forth in claim 11, wherein said safety switch means further includes manually operable means for latching said piston assembly in the closed position of said safety switch means, whereby said apparatus may be used by manually closing said safety switch means before positioning said apparatus and actuating said command switch means.

13. Detonator apparatus for supplying a firing current to a fuse, said apparatus being lowerable into a borehole, and comprising:

a housing with at least one opening therein;

a first switch contact inside said housing;

a plunger assembly slidingly fitted in said housing, movable with respect thereto, and having a second switch contact mounted thereon, and grappling means extending through said opening to engage the walls of the borehole and restrain upward movement of said plunger assembly as said housing is pulled upwardly to electrically connect said first and second switch contacts; and electrical means for generating a firing current to the fuse after said first and second switch contacts have been closed for a predetermined delay time.

14. Detonator apparatus as set forth in claim 13, and further including resilient means positioned between said plunger assembly and said housing, to urge said first and second switch contacts apart.

15. Detonator apparatus as set forth in claim 13, wherein said grappling means include a plurality of relatively stiff but bendable fingers extending upwardly and outwardly from said apparatus, whereby said fingers bend inwardly to allow lowering of said apparatus in the borehole, but resist upward movement once lodged under a pipe end or other surface irregularity in the borehole.

16. Detonator apparatus as set forth in claim 13, and further including an enclosure for said electrical means resiliently mounted within said housing, and having said first switch contact at one end of said enclosure.

17. Detonator apparatus as set forth in claim 13, and further including safety switch means electrically connected to prevent operation of said apparatus unless closed.

18. Detonator apparatus as set forth in claim 17, wherein said electrical means includes means coupled with said safety switch means, to prevent operation of said apparatus unless said safety switch means is closed before closure of said command switch means.

19. Detonator apparatus as set forth in claim 13, wherein said electrical means includes:

electrical time-delay and energy storage means, for generating a triggering signal after said first and second switch contacts have been closed for a predetermined time, and for simultaneously storing sufficient energy to fire the fuse; and circuit means responsive to the triggering signal, for initiating a firing current to the fuse, whereby said electrical time-delay and energy storage means is incapable of firing the fuse without a sustained closure of said first and second switch contacts for the predetermined time.

20. Detonator apparatus as set forth in claim 19, wherein said electrical time delay and energy storage means include resetting means for reinitiating timing of the predetermined time in the event that said first and second switch contacts are opened.

21. Detonator apparatus as set forth in claim 19, wherein:

said electrical time-delay and energy storage means includes power supply means, electrical resistance means, and electrical capacitance means;

said first and second switch contacts, when closed, complete a circuit between said power supply means and said electrical resistance and capacitance means; and the triggering signal is generated when the voltage at a selected point in the circuit rises to a predetermined level as said capacitance means is charged.

22. Detonator apparatus for supplying a firing current to a fuse, said apparatus being lowerable into a borehole, and comprising:

a housing with at least one opening therein;

a first switch contact inside said housing;

a plunger assembly slidingly fitted in said housing, movable with respect thereto, and having a second switch contact mounted thereon, and grappling means extending through said opening to engage the walls of the borehole and restrain upward movement of said plunger assembly as said housing is pulled upwardly to electrically connect said first and second switch contacts;

electrical means for generating a firing current to the fuse after said first and second switch contacts have been closed for a predetermined delay time; and safety switch means electrically connected to prevent operation of said apparatus unless closed, said safety switch means being closeable by hydrostatic pressure, whereby said apparatus is operable only after it has been lowered to a predetermined depth below the surface of a liquid.

23. Detonator apparatus as set forth in claim 22, wherein said safety switch means includes:

an outer housing;

an inner piston assembly slidingly fitted inside said housing, and having a first safety switch contact and a hydrostatic piston;

a second safety switch contact; and resilient means located to urge said first and second safety switch contacts apart, whereby a predetermined pressure acting on said piston is sufficient to overcome the force of said resilient means and to move said first safety switch contact to meet said second safety switch contact and close said safety switch means.

24. Detonator apparatus as set forth in claim 23, wherein said safety switch means further includes manually operable means for latching said piston assembly in the closed position of said safety switch means, whereby said apparatus may be used by manually closing said safety switch means before positioning said apparatus and closing said first and second contacts by pulling upwardly on said housing.

25. Detonator apparatus for supplying a firing current to a fuse, said apparatus being lowerable into a borehole, and comprising:

a housing with at least one opening therein;

a first switch contact inside said housing;

a plunger assembly slidingly fitted in said housing, movable with respect thereto, and having a second switch contact mounted thereon, and grappling means extending through said opening to engage the walls of the borehole and restrain upward movement of said plunger assembly as said housing is pulled upwardly to electrically connect said first and second switch contacts; and electrical means for generating a firing current to the fuse after said first and second switch contacts have been closed for a predetermined delay time, said electrical means including electrical time-delay and energy storage means, for generating a triggering signal after said first and second switch contacts have been closed for a predetermined time, and for simultaneously storing sufficient energy to fire the fuse, said electrical time-delay and energy storage means including power supply means, electrical resistance means, and electrical capacitance means, said first and second switch contacts, when closed, completing a circuit between said power supply means and said electrical resistance and capacitance means, and the triggering signal being generated when the voltage at a selected point in the circuit rises to a predetermined level as said capacitance means is charged, and circuit means responsive to the triggering signal, for initiating a firing current to the fuse, whereby said electrical time-delay and energy storage means is incapable of firing the fuse without a sustained closure of said first and second switch contacts for the predetermined time, said circuit means including electronic latching means switchable to an "on" condition for initiating the firing current in response to the triggering signal, and capable of holding in the "on" condition even when the triggering signal drops below the predetermined voltage level, whereby said electronic latching means ensures that only one attempt is made to fire the fuse.

26. Detonator apparatus as set forth in claim 25 wherein said circuit means for initiating a firing current to the fuse further includes electronic switching means responsive to the "on" condition of said electronic latching means, for connecting said electrical capacitance means across the fuse and attempting to fire the fuse, whereby said electronic switching means also effectively short-circuits said electrical capacitance means and therefore prevents recharging and the generation of a second triggering signal.

27. Detonator apparatus as set forth in claim 26, and further including a safety discharge circuit connected to discharge said electrical capacitance means if an attempt is made to fire an open-circuited fuse, thereby preventing a premature explosion on replacement of the fuse.

28. Detonator apparatus as set forth in claim 26, and further including safety switch means electrically connected in series with the fuse, to prevent operation of said apparatus unless held closed.

29. A detonator circuit for supplying a firing current to a fuse, said circuit comprising:

a power switch for initiating operation of said circuit;

first circuit means, for generating a triggering signal after said power switch has been closed for a predetermined time interval, and for simultaneously storing sufficient energy to fire the fuse, said first circuit means including resetting circuit means for immediately reinitiating timing of the predetermined time interval in the event that said power switch is opened; and second circuit means responsive to the triggering signal, for initiating a firing current to the fuse, whereby said first circuit means is incapable of firing the fuse without a sustained closure of said power switch for the predetermined time interval.

30. A detonator circuit as set forth in claim 29, wherein:

said first circuit means includes power supply means, electrical resistance means, and electrical capacitance means;

said power switch connects said power supply means to said electrical resistance and capacitance means; and the triggering signal is generated when the voltage at a selected point in said first circuit means rises to a predetermined level as said capacitance means is charged.

31. A detonator circuit for supplying a firing current to a fuse, said circuit comprising:

a power switch for initiating operation of said circuit;

first circuit means, for generating a triggering signal after said power switch has been closed for a predetermined time interval, and for simultaneously storing sufficient energy to fire the fuse, said first circuit means including power supply means, electrical resistance means, and electrical capacitance means, said power switch being operative to connect said power supply means to said electrical resistance and capacitance means, and the triggering signal being generated when the voltage at a selected point in said first circuit means rises to a predetermined level as said capacitance means is charged; and second circuit means responsive to the triggering signal, for initiating a firing current to the fuse, whereby said first circuit means is incapable of firing the fuse without a sustained closure of said power switch for the predetermined time interval, said second circuit means including electronic latching means switchable to an "on" condition for initiating the firing current in response to the triggering signal, and capable of holding in the "on" condition even when the triggering signal drops below the predetermined voltage level, whereby said electronic latching means ensures that only one attempt is made to fire the fuse.

32. A detonator circuit as set forth in claim 31, wherein said second circuit means includes electronic switching means responsive to the "on" condition of said electronic latching means, for connecting said electrical capacitance means across the fuse and attempting to fire the fuse, whereby said electronic switching means also effectively short-circuits said electrical capacitance means and therefore prevents recharging and the generation of a second triggering signal.

33. A detonator circuit as set forth in claim 32, wherein said first circuit means includes resetting means for completely discharging said electrical capacitance means and thereby reinitiating a new timing phase in the event that said power switch is opened.

34. A detonator circuit as set forth in claim 32, and further including a safety discharge circuit connected to discharge said electrical capacitance means if an attempt is made to fire an open-circuited fuse, thereby preventing a premature explosion on replacement of the fuse.

35. A detonator circuit as set forth in claim 32, and further including a safety switch electrically connected in series with the fuse, to prevent operation of said apparatus unless held closed.

36. A detonator circuit as set forth in claim 35, and further including means for generating the triggering signal immediately if said power switch is closed before said safety switch, thereby short-circuiting said electrical capacitance means and preventing charging thereof.

37. A detonator circuit as set forth in claim 32, wherein said second circuit means further includes high-frequency filter means to render said second circuit means unresponsive to high-frequency noise and interference signals.

38. A method of safely detonating an underground explosive charge using an electromechanical device, said method comprising the steps of:

lowering the device into position in a borehole;

closing a command switch on the device by pulling upwardly on its housing;

holding the command switch closed for at least a predetermined time interval;

charging an energy storage component while the command switch is held closed;

generating a triggering signal when the predetermined time interval has elapsed;

electronically connecting the energy storage component across a detonator fuse in response to said triggering signal; and latching the circuit, simultaneously with said connecting step, to effectively short-circuit the energy storage component and thereby prevent a second attempt at firing the fuse.

39. A method as set forth in claim 38, and further including:

discharging the energy storage component on opening of the command switch; and unlatching the circuit, on opening of the command switch, to allow recycling if the command switch is subsequently closed.

40. A method as set forth in claim 38, and further including the step of closing a safety switch prior to said step of closing the command switch, whereby, if said step of closing the safety switch is not performed before said step of closing the command switch, then said generating, connecting and latching steps are performed without said charging step, and insufficient energy is available to fire the fuse.

* * * * *